US009308623B2

(12) United States Patent
Chen et al.

(10) Patent No.: US 9,308,623 B2
(45) Date of Patent: Apr. 12, 2016

(54) MULTI-DISK CHEMICAL MECHANICAL POLISHING PAD CONDITIONERS AND METHODS

(71) Applicant: Applied Materials, Inc., Santa Clara, CA (US)

(72) Inventors: Hung Chen, Sunnyvale, CA (US); Shou-Sung Chang, Mountain View, CA (US); Jason Garcheung Fung, Sunnyvale, CA (US); Matthew A. Gallelli, Palo Alto, CA (US); Paul D. Butterfield, San Jose, CA (US); Kevin Chou, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 14/256,704

(22) Filed: Apr. 18, 2014

(65) Prior Publication Data

US 2014/0315473 A1 Oct. 23, 2014

Related U.S. Application Data

(60) Provisional application No. 61/814,182, filed on Apr. 19, 2013.

(51) Int. Cl.
*B24B 53/017* (2012.01)

(52) U.S. Cl.
CPC ..... *B24B 53/017* (2013.01)

(58) Field of Classification Search
CPC ..... B24B 53/017
USPC ..... 451/443, 444, 56, 72, 21, 270, 271
See application file for complete search history.

(56) References Cited

U.S. PATENT DOCUMENTS

| | | | | |
|---|---|---|---|---|
| 6,135,868 | A | 10/2000 | Brown et al. | |
| 6,159,087 | A | 12/2000 | Birang et al. | |
| 6,371,836 | B1 | 4/2002 | Brown et al. | |
| 6,386,963 | B1 * | 5/2002 | Kenji et al. | 451/443 |
| 6,572,446 | B1 | 6/2003 | Osterheld et al. | |

(Continued)

FOREIGN PATENT DOCUMENTS

JP 2000-190201 7/2000

OTHER PUBLICATIONS

Birang et al., U.S. Appl. No. 09/666,510, titled "Improved End Effector for Pad Conditioning," filed Sep. 20, 2000.

(Continued)

*Primary Examiner* — Robert Rose
(74) *Attorney, Agent, or Firm* — Dugan & Dugan, PC

(57) ABSTRACT

A pad conditioner may include multiple independently mounted conditioning elements configured to condition a polishing pad used in, e.g., a chemical mechanical polishing (CMP) process. In some embodiments, the pad conditioner may include a main assembly disk and a main assembly base plate attached to the main assembly disk via a gimbal connection. A plurality of pad conditioner assemblies may be attached to the main assembly base plate. In some embodiments, each pad conditioner assembly may include a pad conditioner disk attached to the main assembly base plate, a pad conditioner base attached to the pad conditioner disk via a gimbal connection, and a conditioning element attached to the pad conditioner base. Methods of conditioning a polishing pad are also provided, as are other aspects.

15 Claims, 6 Drawing Sheets

(56) References Cited

U.S. PATENT DOCUMENTS

| | | | | |
|---|---|---|---|---|
| 6,899,604 | B2 * | 5/2005 | Togawa et al. | 451/72 |
| 6,949,016 | B1 * | 9/2005 | de la Llera et al. | 451/285 |
| 7,066,795 | B2 | 6/2006 | Balagani et al. | |
| 7,288,165 | B2 | 10/2007 | Polyak et al. | |
| 7,459,056 | B2 | 12/2008 | Polyak et al. | |
| 7,597,608 | B2 | 10/2009 | Chang et al. | |
| 7,815,495 | B2 | 10/2010 | Xu et al. | |
| 2007/0212983 | A1 | 9/2007 | Nangoy et al. | |
| 2008/0254722 | A1 * | 10/2008 | Xu et al. | 451/444 |
| 2010/0105302 | A1 * | 4/2010 | Chen et al. | 451/526 |

OTHER PUBLICATIONS

Tang et al., U.S. Appl. No. 13/869,307 (20451), titled: "Methods and Apparatus Using Energized Fluids to Clean Chemical Mechanical Planarization Polishing Pads," filed Apr. 24, 2013.

International Search Report and Written Opinion of International Application No. PCT/US2014/034688 mailed Aug. 11, 2014.

International Preliminary Report and Written Opinion of International Application No. PCT/US2014/034688 mailed Oct. 29, 2015.

* cited by examiner

MULTI-DISK CHEMICAL MECHANICAL POLISHING PAD CONDITIONERS AND METHODS

RELATED APPLICATION

This claims priority to U.S. Provisional Patent Application No. 61/814,182, filed Apr. 19, 2013, and titled "MULTI-DISK CHEMICAL MECHANICAL POLISHING PAD CONDITIONERS AND METHODS", which is hereby incorporated by reference herein for all purposes.

FIELD

The invention relates generally to semiconductor device manufacturing, and more particularly to a pad conditioner for conditioning a chemical mechanical polishing pad.

BACKGROUND

Chemical mechanical polishing (CMP), also known as chemical mechanical planarization, is a process typically used in the fabrication of integrated circuits and/or display elements. CMP processes may remove topographic features and materials from a partially-processed substrate to produce a flat surface for subsequent processing. CMP processes may use one or more rotating polishing pads pressed against a surface of a substrate. The polishing pads may be used with an abrasive chemically-active slurry applied to the pads. A slurry may be a suspension of abrasive solids in a liquid.

After a CMP process is performed repeatedly over a period of time, the polishing surface of the polishing pad may become glazed with an accumulation of slurry by-products and/or material removed from the substrate. Glazing may degrade the effectiveness of a polishing pad. A conditioning process using a pad conditioner may restore the effectiveness of the polishing pad. A pad conditioner may include an abrasive head that can be rubbed against a surface of the polishing pad to remove unwanted accumulations and to retexture the pad. However, while pad conditioning occurs, CMP processing of substrates may not, thus decreasing substrate throughput. Therefore, a need exists to provide pad conditioners that can quickly condition CMP polishing pads.

SUMMARY

According to one aspect, apparatus for conditioning a polishing pad is provided. The apparatus comprises a main assembly and a plurality of pad conditioner assemblies each compliantly attached to the main assembly and each comprising a conditioning element.

According to another aspect, a system for conditioning a polishing pad is provided. The system comprises a conditioning head and a pad conditioner mounted to the conditioning head, the pad conditioner comprising a plurality of independently mounted conditioning elements.

According to a further aspect, a method of conditioning a polishing pad is provided. The method comprises providing a plurality of pad conditioner assemblies, each pad conditioner assembly having a pad conditioner base attached to a pad conditioner disk, attaching the plurality of pad conditioner assemblies to a main assembly base plate, and attaching the main assembly base plate to a main assembly disk.

Still other aspects, features, and advantages of the invention may be readily apparent from the following detailed description wherein a number of example embodiments and implementations are described and illustrated, including the best mode contemplated for carrying out the invention. The invention may also include other and different embodiments, and its several details may be modified in various respects, all without departing from the scope of the invention. Accordingly, the drawings and descriptions are to be regarded as illustrative in nature, and not as restrictive. The drawings are not necessarily drawn to scale. The invention covers all modifications, equivalents, and alternatives falling within the scope of the invention.

BRIEF DESCRIPTION OF DRAWINGS

The drawings, described below, are for illustration purposes only. The drawings are not intended to limit the scope of this disclosure in any way.

DETAILED DESCRIPTION

Reference will now be made in detail to the example embodiments of this disclosure, which are illustrated in the accompanying drawings. Wherever possible, the same reference numbers will be used throughout the drawings to refer to the same or like parts.

In one aspect, a pad conditioner may include multiple independently mounted conditioning elements configured to condition a polishing pad used in, e.g., a chemical mechanical polishing (CMP) process. The pad conditioner may include a main assembly disk and a main assembly base plate attached to the main assembly disk. The main assembly disk may be made of a compliant material. The main assembly base plate may be made of a rigid material and, in some embodiments, may be attached to the main assembly disk via a gimbal connection. A plurality of pad conditioner assemblies may be attached to the main assembly base plate. Each pad conditioner assembly may include a pad conditioner disk attached to the main assembly base plate, and a pad conditioner base attached to the pad conditioner disk. In some embodiments, the pad conditioner base may be attached to the pad conditioner disk via a gimbal connection. The pad conditioner disk may be made of a compliant material and the pad conditioner base may be made of a rigid material. In some embodiments, the pad conditioner base may have a replaceable conditioning element attached thereto. The plurality of pad conditioner assemblies may increase conditioning efficiency by providing to a polishing pad more abrasive conditioning in less time than conventional pad conditioners. This may reduce conditioning process time and, accordingly, may improve substrate throughput. In other aspects, methods of conditioning a polishing pad are provided, as will be explained in greater detail below in connection with FIGS. 1-13.

Figure 1:
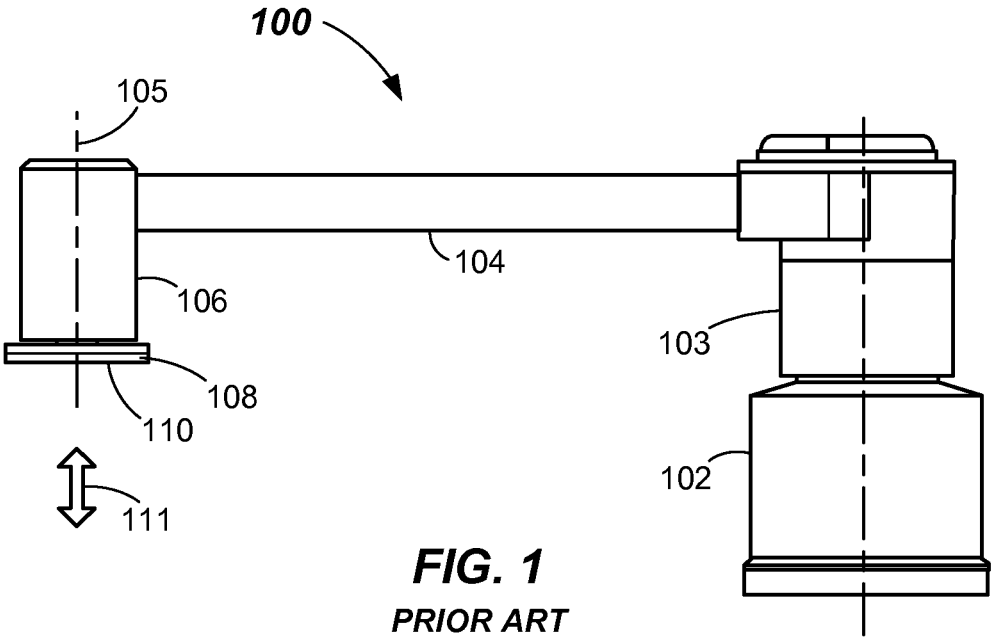
FIG. 1 PRIOR ART
FIG. 1 illustrates a side view of a pad conditioning assembly according to the prior art.

FIG. 1 illustrates a known pad conditioning assembly 100 in accordance with the prior art. Pad conditioning assembly 100 may include a base 102, an arm 104, a conditioning head 106, and a pad conditioner 108 mounted to conditioning head 106. Pad conditioner 108 may have a conditioning surface 110 with abrasive particles thereon (see, e.g., FIG. 2, described below). Conditioning surface 110 may be configured to rub against a polishing pad surface. Conditioning head 106 may be configured to vertically move pad conditioner 108 (as indicated by arrow 111) from an elevated retracted position (as shown in FIG. 1) to a lowered extended position such that conditioning surface 110 of pad conditioner 108 may engage a polishing surface of a polishing pad (not shown). Conditioning head 106 may further be configured to rotate pad conditioner 108 about longitudinal axis 105. Arm 104 may be configured to rotate about longitudinal axis 103 such that conditioning head 106 may sweep across a polishing pad surface (not shown) with a reciprocal motion. The rotating motion of pad conditioner 108 and the reciprocating motion of conditioning head 106 may cause conditioning surface 110 of pad conditioner 108 to condition the polishing surface of the polishing pad by abrading the polishing surface to remove contaminants and to retexture the surface.

Figure 2:
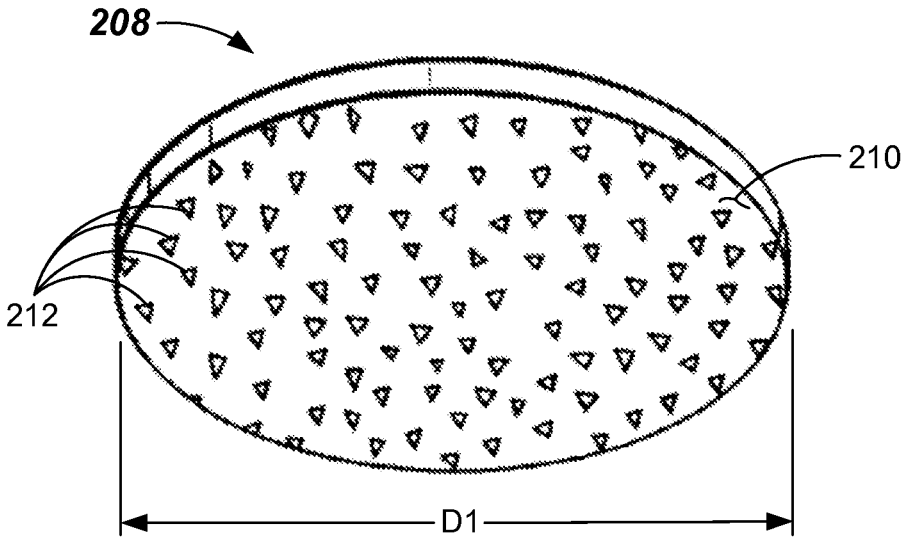
FIG. 2 PRIOR ART
FIG. 2 illustrates a bottom perspective view of pad conditioner according to the prior art.

FIG. 2 shows a known pad conditioner 208 that may have a conditioning surface 210 covered with a pattern of abrasive particles 212. Pad conditioner 208 may typically be made of metal or other suitably rigid material. Abrasive particles 212 may be pointed and/or pyramid shaped as shown or, alternatively, may be prism shaped, wherein the prisms may be rectangular, square, circular, or oval, among others. Other suitable shapes may also be used. The shape of abrasive particles 212 may determine the aggressiveness of the conditioning process. Abrasive particles 212 may be made of metal, diamond or diamond-tipped, plastic, or other suitable material(s). Abrasive particles 212 may either be uniformly or non-uniformly distributed across conditioning surface 210, and/or may be arranged in various patterns including, e.g., spiral, circular, segmented, spoked, rectangular, and/or arced, among others. Some pad conditioners may have a diameter D1 of about 4.25 inches (about 10.8 cm).

Figure 3:
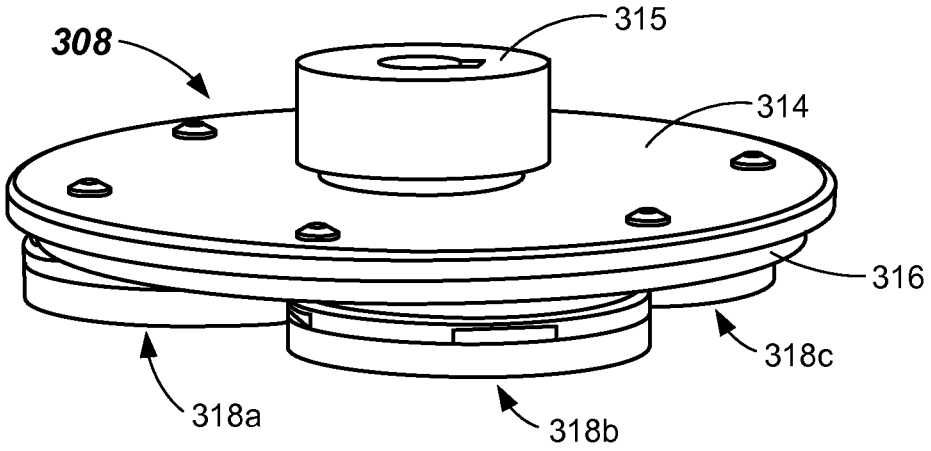
FIG. 3 illustrates a front perspective view of a multi-disk pad conditioner according to embodiments.
Figure 4:
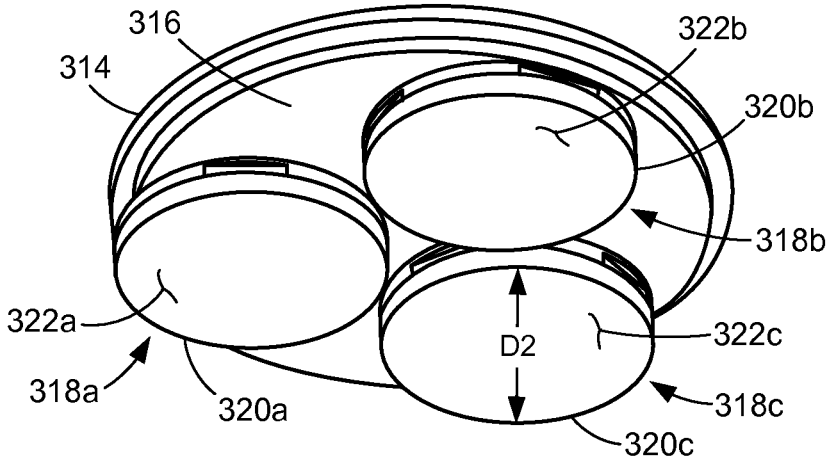
FIG. 4 illustrates a bottom perspective view of the multi-disk pad conditioner of FIG. 3 according to embodiments.

FIGS. 3 and 4 show top and bottom perspective views, respectively, of a pad conditioner 308 in accordance with one or more embodiments. Pad conditioner 308 may have a main assembly disk 314, a main assembly base plate 316, and in some embodiments, three pad conditioner assemblies 318*a*, 318*b*, and 318*c*. Other embodiments may have other suitable numbers of pad conditioner assemblies. Main assembly disk 314 may have a central portion 315 that may be configured to attach to a conditioning head, such as, e.g., conditioning head 106 of FIG. 1. Main assembly disk 314 may attach to a conditioning head in any suitable manner, such as, e.g., via a threaded coupling (see, e.g., FIG. 5, described below).

As shown in FIG. 4, each pad conditioner assembly 318*a*, 318*b*, and 318*c* may include a conditioning element 320*a*, 320*b*, and 320*c*, respectively. Each conditioning element 320*a*, 320*b*, and 320*c* may have abrasive particles (not shown) of any suitable size, type, and/or arrangement on respective conditioning surface 322*a*, 322*b*, and 322*c*, including, e.g., those described above in connection with pad conditioner 208. In some embodiments, each conditioning element 320*a*, 320*b*, and 320*c* may have a diameter D2 of about one inch (about 2.5 cm). Conditioning surfaces 322*a*, 322*b*, and 322*c* may provide additional points of contact on a polishing pad surface for additional and/or more efficient conditioning than conventional pad conditioners with a single conditioning surface. That is, additional and/or more efficient conditioning may occur because each conditioning surface 322*a*, 322*b*, and 322*c* may concurrently contact the polishing pad surface. Thus, conditioning process time may be reduced, and the useful life of conditioning elements 320*a*, 320*b*, and/or 320*c* may accordingly be extended in comparison to conventional pad conditioners.

Figure 5:
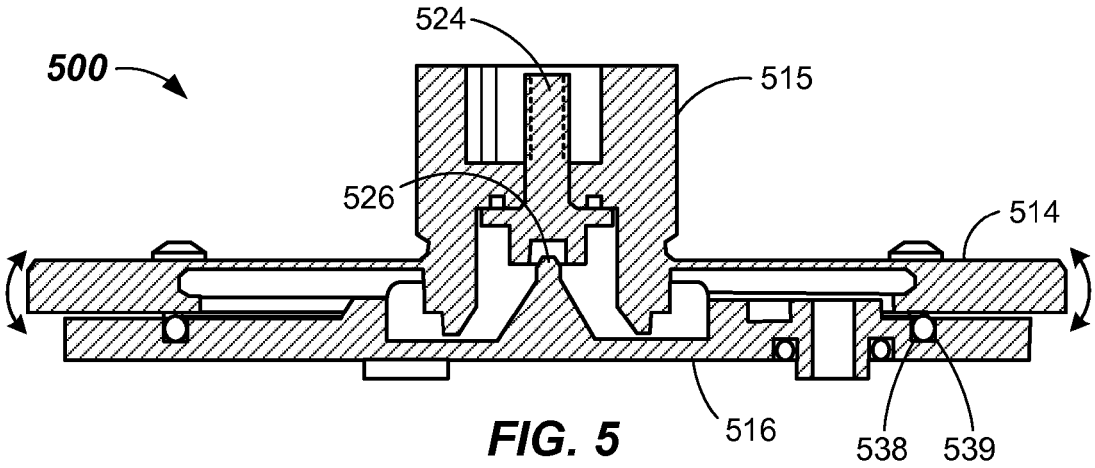
FIG. 5 illustrates a cross-sectional view of a main assembly of a multi-disk pad conditioner according to embodiments.
Figure 6:
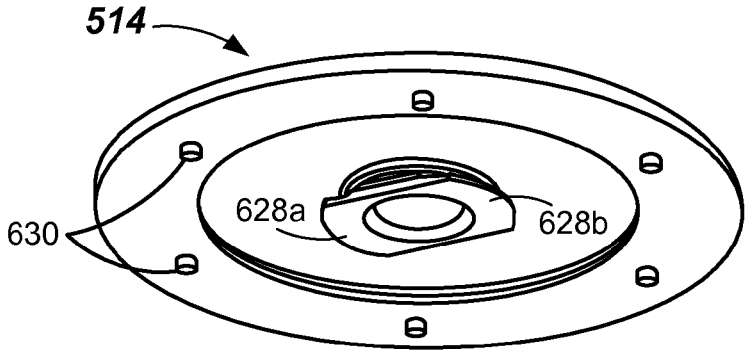
FIG. 6 illustrates a bottom perspective view of a main assembly disk according to embodiments.
Figure 7:
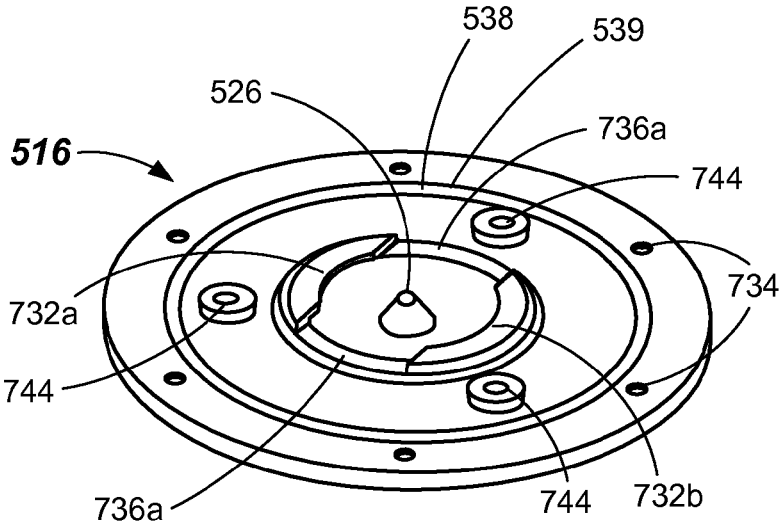
FIG. 7 illustrates a top perspective view of a main assembly base according to embodiments.

FIGS. 5-7 show a main assembly 500 that may include a main assembly disk 514 and a main assembly base plate 516 of a pad conditioner in accordance with one or more embodiments. Main assembly disk 514 may have a central portion 515 that, in some embodiments, may have a threaded gimbal seal screw 524 that may be configured to attach to a conditioning head, such as, e.g., conditioning head 106 of FIG. 1. In other embodiments, main assembly disk 514 may attach to a conditioning head in any suitable manner. Main assembly disk 514 may be made with a suitably compliant material such as, e.g., suitably thin stainless steel sheet metal or suitable plastics such as, e.g., PET, PPS, or PEEK, that may allow, in some embodiments, flexing on the order of about 0.5 degrees.

Main assembly base plate 516 may attach to main assembly disk 514 in some embodiments via a gimbal connection. The gimbal connection may allow main assembly disk 514 to flex or pivot in any direction about a pivot point 526 (as illustrated by the pair of double-headed arrows in FIG. 5) during a conditioning process. In some embodiments, the gimbal connection may include a quarter-turn coupling having the following features illustrated in FIGS. 6 and 7: Main assembly disk 514 may have a pair of centered flanges 628*a* and 628*b* and a plurality of generally peripheral guide pins 630. The number of guide pins 630 may be more or less than that shown in FIG. 6. Main assembly base plate 516 may have a pair of corresponding pockets 732*a* and 732*b* and a plurality of corresponding guide pin holes 734. Main assembly base plate 516 may be attached to main assembly disk 514 by positioning main assembly base plate 516 against main assembly disk 514 such that flanges 628*a* and 628*b* are aligned in cutout areas 736*a* and 736*b*. Main assembly base plate 516 may then be rotated one quarter turn in either direction. This may cause flanges 628*a* and 628*b* to be received in pockets 732*a* and 732*b* and guide pins 630 to be received in guide pin holes 734. Main assembly base plate 516 may also include an O-ring 538 seated in a groove 539 that may contact main assembly disk 514. In some embodiments, main assembly base plate 516 may be made of metal or other suitably rigid material, such as, e.g., stainless steel or plastics such as, e.g., PET, PPS, or PEEK of suitable thickness and/or geometry. In alternative embodiments, main assembly base plate 516 may be attached to main assembly disk 514 in any suitable manner and with or without a gimbal connection.

Figure 8:
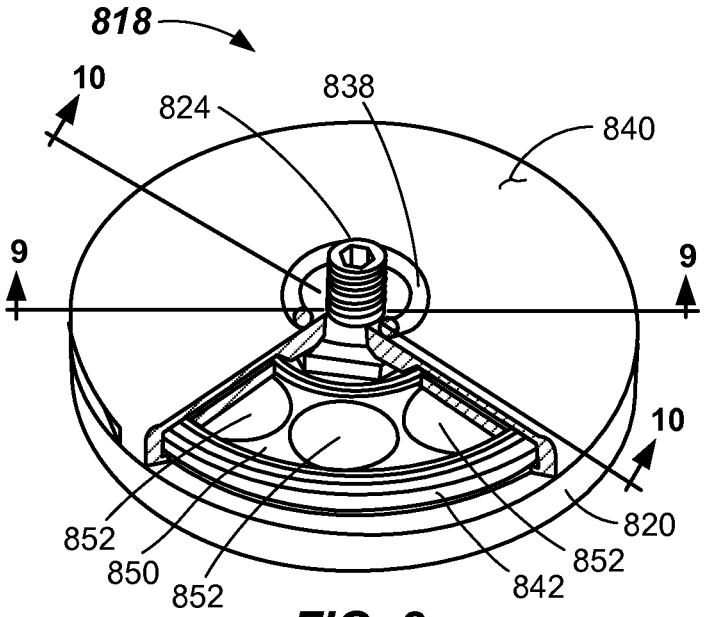
FIG. 8 illustrates a top perspective view of a pad conditioner assembly according to embodiments.
Figure 9:
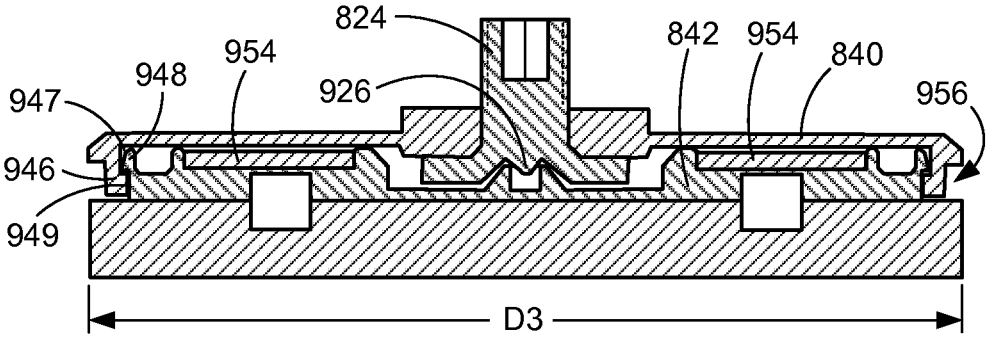
FIG. 9 illustrates a cross-sectional view of the pad conditioner assembly of FIG. 8 taken along line 9-9 according to embodiments.
Figure 10:
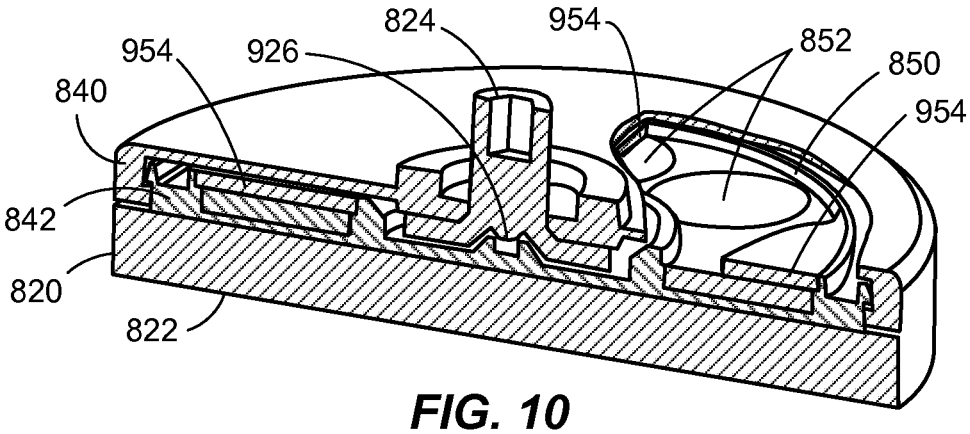
FIG. 10 illustrates a cross-sectional perspective view of the pad conditioner assembly of FIG. 8 taken along line 10-10 according to embodiments.
Figure 11:
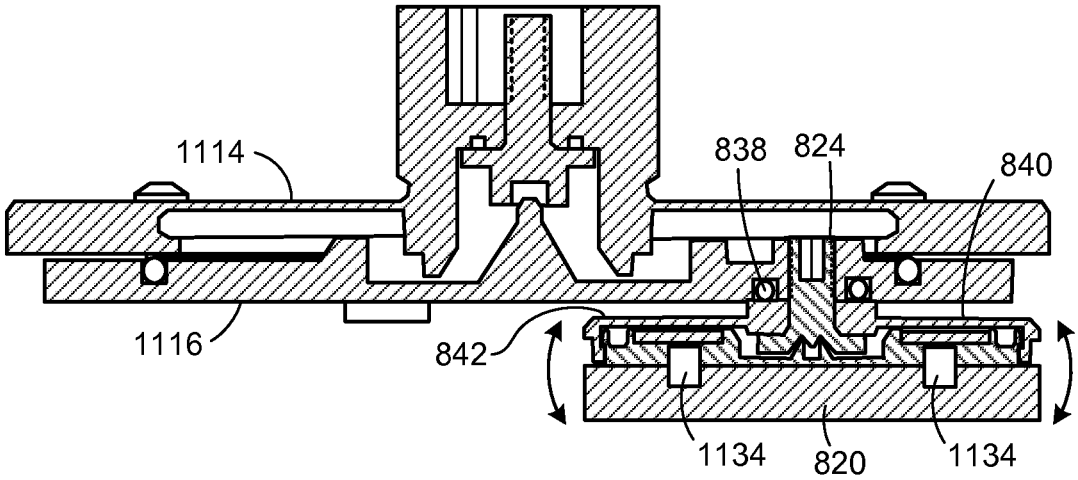
FIG. 11 illustrates a cross-sectional view of a multi-disk pad conditioner with one pad conditioner assembly according to embodiments.

FIGS. 8-10 show a pad conditioner assembly 818 in accordance with one or more embodiments. Pad conditioner assembly 818 may be used with, e.g., pad conditioner 308. Pad conditioner assembly 818 may include a pad conditioner disk 840 and a pad conditioner base 842. Pad conditioner disk 840 may be made of a suitably compliant material, such as, e.g., suitably thin stainless steel sheet metal or suitable plastics such as, e.g., PET, PPS, or PEEK, while pad conditioner base 842 may be made of a suitably rigid material, such as, e.g., stainless steel or plastics such as, e.g., PET, PPS, or PEEK of suitable thickness and/or geometry. Pad conditioner disk 840 may be configured to attach to a main assembly base plate, such as, e.g., either of main assembly base plates 316 and/or 516. In some embodiments, pad conditioner disk 840 may attach to a main assembly base plate via, e.g., a threaded gimbal screw 824, which may be received in a threaded hole, such as, e.g., one of threaded holes 744 of main assembly base plate 516, as shown in FIGS. 5 and 7. In some embodiments, as shown in FIG. 11, the insertion of threaded gimbal screw 824 in a main assembly base plate 1116 may sandwich or clamp pad conditioner disk 840 to main assembly base plate 1116. An O-ring 838 (shown in FIGS. 8 and 11) may be provided between pad conditioner disk 840 and main assembly base plate 1116.

Referring to FIGS. 9-11, pad conditioner base 842 may be attached to pad conditioner disk 840 in some embodiments via a gimbal connection. This may allow pad conditioner disk 840 to flex or pivot in any direction about a pivot point 926 during a conditioning process, as illustrated in FIG. 11 by the pair of double-headed arrows. In some embodiments, the gimbal connection may include a snap-on arrangement between pad conditioner disk 840 and pad conditioner base 842. Pad conditioner disk 840 may have a sidewall 946 with an interior recess 947 that may correspond to an exterior rib 948 on pad conditioner base 842. Pad conditioner base 842 may be attached to pad conditioner disk 840 by pressing pad conditioner base 842 into the bottom of pad conditioner disk 840, which may cause sidewall 946 to momentarily flex outward enough to allow exterior rib 948 to pass through a smaller diameter lower portion 949 of sidewall 946 and seat in interior recess 947. In other embodiments, pad conditioner base 842 may be attached to pad conditioner disk 840 in any suitable manner and with or without a gimbal connection.

In some embodiments, pad conditioner assembly 818 may include a conditioning element 820. Conditioning element 820 may be made of metal or other suitable material, such as, e.g., stainless steel or plastics such as, e.g., acrylic. Conditioning element 820 may have abrasive particles (not shown) of any suitable size, type, and/or arrangement on a conditioning surface 822, including, e.g., those described above in connection with pad conditioner 208. In some embodiments, each conditioning element 820 may have a diameter D3 of about one inch (about 2.5 cm).

In some embodiments, conditioning element 820 may be magnetically attached to pad conditioner base 842. As shown in FIGS. 8 and 10, pad conditioner base 842 may have in some embodiments a channel 850 that has one or more magnets 852 positioned therein. Channel 850 may have a channel cover plate 954 enclosing channel 850. The one or more magnets 852 may be sized to magnetically attach and hold conditioning element 820 in place during a conditioning process. In at least these embodiments, conditioning element 820 may be made of a suitable magnetically-attracted material.

Figure 12:
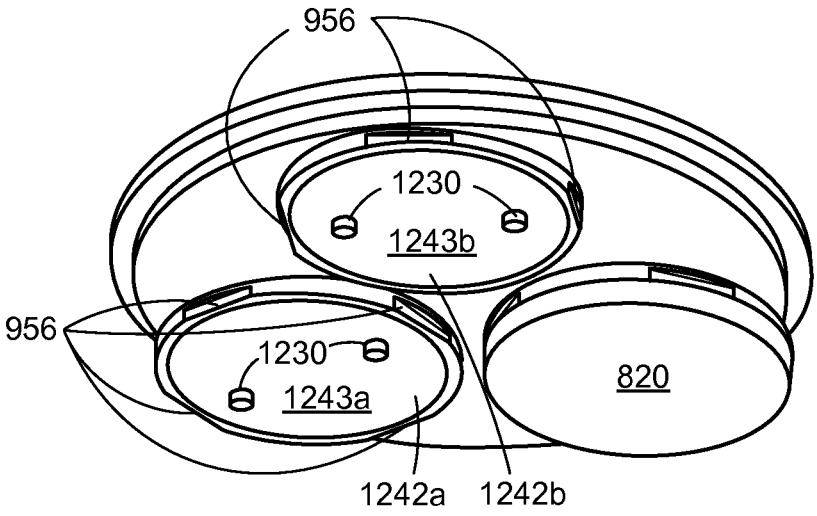
FIG. 12 illustrates a bottom perspective view of a multi-disk pad conditioner with three pad conditioner assemblies, one with a conditioning element and two without conditioning elements.

To assist with attachment of a conditioning element 820 to a pad conditioner base, a pair of guide pins 1230 may be provided in some embodiments on the bottom surface of a pad conditioner base, as shown in FIG. 12 on each of bottom surfaces 1243*a* and 1243*b* of pad conditioner bases 1242*a* and 1242*b*, respectively. The number of guide pins 1230 may be more or less than that shown in FIG. 12. Conditioning element 820 may accordingly have corresponding guide pin holes 1134, as shown in FIG. 11.

To assist with removal of a conditioning element 820 from a pad conditioner base 842, pad conditioner disk 840 may have in some embodiments one or more cutout features 956 in sidewall 946, as shown in FIGS. 9 and 12. Although four cutout features 956 are shown positioned around the periphery of each of pad conditioner disks 1240*a* and 1240*b* in FIG. 12, other suitable numbers of cutout features 956 may be provided. Cutout features 956 may be used with a suitable tool, such as, e.g., a screwdriver, to pry conditioning element 820 away from pad conditioner base 842.

In other embodiments, conditioning element 820 may be attached to pad conditioner base 842 in any suitable manner.

In other embodiments, pad conditioner base 842 may have a conditioning surface, such as, e.g., conditioning surface 210, integrally formed thereon.

Figure 13:
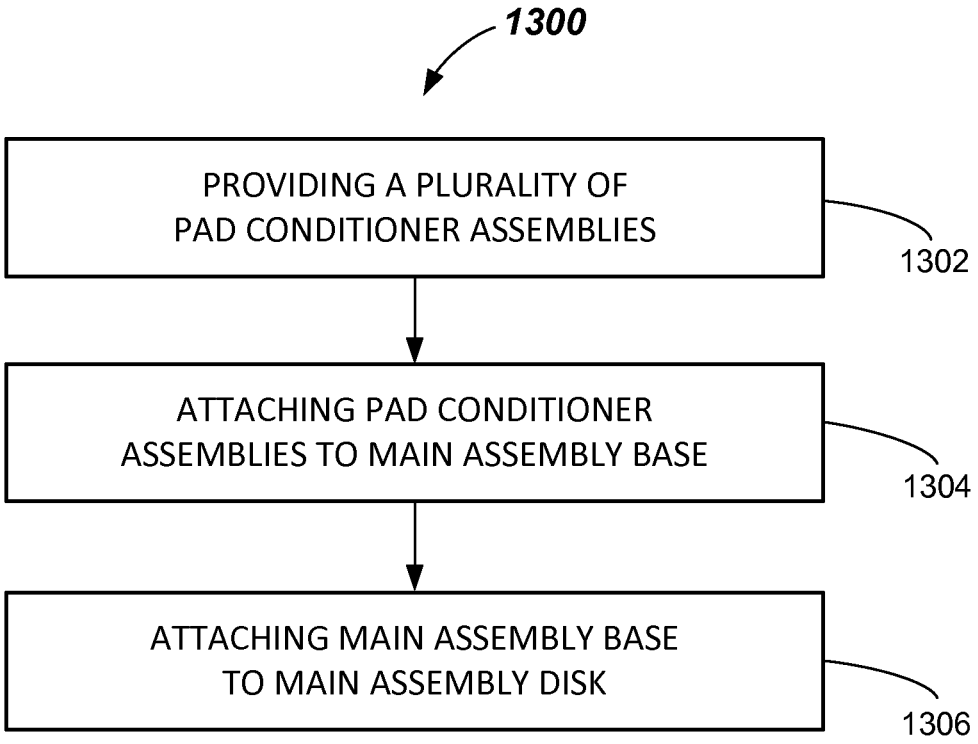
FIG. 13 illustrates a flowchart of a method of conditioning a polishing pad according to embodiments.

FIG. 13 illustrates a method 1300 of conditioning a polishing pad in accordance with one or more embodiments. The polishing pad may be used in a CMP process. At process block 1302, method 1300 may include providing a plurality of pad conditioner assemblies, wherein each pad conditioner assembly may have a pad conditioner base attached to a pad conditioner disk and, in some embodiments, the pad conditioner base may be attached to the pad conditioner disk via a gimbal connection. The pad conditioner base may be configured to receive a conditioning element. For example, referring to FIGS. 8-10, the pad conditioner assemblies may each be pad conditioner assembly 818, the pad conditioner base may be pad conditioner base 842, and the pad conditioner disk may be pad conditioner disk 840.

At process block 1304, the plurality of pad conditioner assemblies may be attached to a main assembly base plate. As shown, e.g., in FIGS. 5 and 11, the main assembly base plate may be main assembly base plate 516 or 1116.

At process block 1306, method 1300 may include attaching the main assembly base plate to a main assembly disk. In some embodiments, the main assembly base plate may be attached to the main assembly disk via a gimbal connection. As again shown, e.g., in FIGS. 5 and 11, the main assembly disk may be main assembly disk 514 or 1114.

The above process blocks of method 1300 can be executed or performed in an order or sequence not limited to the order and sequence shown and described. For example, in some embodiments, process block 1306 may be performed before process block 1302 and/or 1304.

Persons skilled in the art should readily appreciate that the invention described herein is susceptible of broad utility and application. Many embodiments and adaptations of the invention other than those described herein, as well as many variations, modifications, and equivalent arrangements, will be apparent from, or reasonably suggested by, the invention and the foregoing description thereof, without departing from the substance or scope of the invention. For example, although described in connection with polishing pads of chemical mechanical polishing processes, one or more embodiments of the invention may be used with other types of polishing and/or processing pads that can be conditioned or reconditioned with a pad conditioner. Accordingly, while the invention has been described herein in detail in relation to specific embodiments, it should be understood that this disclosure is only illustrative and presents examples of the invention and is made merely for purposes of providing a full and enabling disclosure of the invention. This disclosure is not intended to limit the invention to the particular apparatus, devices, assemblies, systems, or methods disclosed, but, to the contrary, the intention is to cover all modifications, equivalents, and alternatives falling within the scope of the invention.

What is claimed is:

1. Apparatus for conditioning a polishing pad, comprising:

a main assembly; and a plurality of pad conditioner assemblies each compliantly attached to the main assembly and each comprising a conditioning element, wherein each pad conditioner assembly further includes a pad conditioner disk attached to the main assembly, and a pad conditioner base attached to the pad conditioner disk via a gimbal connection, the conditioning element attached to the pad conditioner base.

2. The apparatus of claim 1 wherein the main assembly comprises a main assembly disk and a main assembly base plate attached to the main assembly disk.

3. The apparatus of claim 2 wherein the main assembly base plate is attached to the main assembly disk via a gimbal connection.

4. The apparatus of claim 2 wherein the main assembly base plate is made of a rigid material and the main assembly disk is made of a compliant material.

5. The apparatus of claim 1 wherein the pad conditioner disk is made of a compliant material and the pad conditioner base is made of a rigid material.

6. The apparatus of claim 1 wherein the pad conditioner base comprises at least one magnet and the conditioning element is attached to the pad conditioner base magnetically.

7. A system for conditioning a polishing pad, comprising:

a conditioning head; and a pad conditioner mounted to the conditioning head, the pad conditioner comprising a plurality of independently mounted conditioning elements, wherein each of the conditioning elements is attached to a respective pad conditioner base, and wherein each pad conditioner base is attached to a respective pad conditioner disk via a gimbal connection.

8. The system of claim 7 wherein each pad conditioner disk is attached to a main assembly base plate.

9. The system of claim 8 wherein each pad conditioner disk is configured to pivot about a pivot point during a conditioning process.

10. The system of claim 8 wherein the main assembly base plate is attached to a main assembly disk.

11. The system of claim 10 wherein the main assembly disk is configured to pivot about a pivot point during a conditioning process.

12. A method of conditioning a polishing pad, comprising:

providing a plurality of pad conditioner assemblies, each pad conditioner assembly having a pad conditioner base attached to a pad conditioner disk via a first gimbal connection;

attaching the plurality of pad conditioner assemblies to a main assembly base plate;

attaching the main assembly base plate to a main assembly disk; and conditioning a polishing pad using the plurality of pad conditioner assemblies.

13. The method of claim 12 wherein the attaching the main assembly base plate to the main assembly disk comprises attaching the main assembly base plate to the main assembly disk via a second gimbal connection.

14. The method of claim 12 further comprising attaching a respective conditioning element to each pad conditioner base.

15. The method of claim 14 wherein the attaching the respective conditioning element to each pad conditioner base comprises attaching the respective conditioning element to each pad conditioner base magnetically via at least one magnet included in each pad conditioner base.

* * * * *